US008556092B2

(12) United States Patent
Valiulis et al.

(10) Patent No.: US 8,556,092 B2
(45) Date of Patent: Oct. 15, 2013

(54) STAND ALONE DIVIDER FOR SHELVING

(75) Inventors: Thomas E. Valiulis, Rockford, IL (US); Patrick J. Barkdoll, Pecatonica, IL (US); Stanley J. Valiulis, Rockford, IL (US)

(73) Assignee: Southern Imperial, Inc., Rockford, IL (US)

( * ) Notice: Subject to any disclaimer, the term of this patent is extended or adjusted under 35 U.S.C. 154(b) by 63 days.

(21) Appl. No.: 13/184,893

(22) Filed: Jul. 18, 2011

(65) Prior Publication Data

US 2013/0020270 A1 Jan. 24, 2013

(51) Int. Cl.

| | |
|---|---|
| ***A47F 5/00*** | (2006.01) |
| *A47B 65/00* | (2006.01) |
| *A47B 57/00* | (2006.01) |
| *B65D 1/24* | (2006.01) |

(52) U.S. Cl.

USPC ..... 211/184; 211/43; 211/175; 248/298.1; 108/61; 220/551

(58) Field of Classification Search

USPC ..... 211/184, 175, 10, 42, 43; 108/60, 61; 312/348.3; 248/298.1, 257, 265, 269

See application file for complete search history.

(56) References Cited

U.S. PATENT DOCUMENTS

| | | | | |
|---|---|---|---|---|
| 1,714,266 | A * | 5/1929 | Johnson | 220/8 |
| 1,849,024 | A * | 3/1932 | McKee | 160/216 |
| 1,953,450 | A * | 4/1934 | Thompson | 248/263 |
| 1,995,335 | A * | 3/1935 | Wilke | 312/140 |
| 2,884,139 | A * | 4/1959 | Dunham | 211/184 |
| 2,885,091 | A * | 5/1959 | Van Pelt | 211/184 |
| 3,497,081 | A * | 2/1970 | Field | 211/184 |
| 3,501,019 | A * | 3/1970 | Armstrong et al. | 211/184 |
| 3,559,815 | A * | 2/1971 | Huddleston | 211/184 |
| 3,698,568 | A * | 10/1972 | Armstrong | 211/184 |
| 3,830,169 | A * | 8/1974 | Madey | 108/61 |
| 3,872,976 | A * | 3/1975 | Moore et al. | 211/184 |
| 3,945,599 | A * | 3/1976 | Spier et al. | 248/476 |
| 4,023,682 | A * | 5/1977 | Niece | 211/184 |
| 4,395,955 | A * | 8/1983 | Pfeifer | 108/61 |
| 4,488,653 | A * | 12/1984 | Belokin | 211/184 |
| 4,712,694 | A * | 12/1987 | Breslow | 211/184 |
| 4,768,661 | A * | 9/1988 | Pfeifer | 211/184 |
| 4,889,253 | A * | 12/1989 | Schmulian et al. | 220/551 |
| 5,039,181 | A * | 8/1991 | Lautenschlager | 312/334.7 |
| 5,265,993 | A * | 11/1993 | Wayne | 410/129 |
| 5,341,945 | A * | 8/1994 | Gibson | 211/184 |
| 5,437,380 | A * | 8/1995 | Peay et al. | 211/184 |
| 5,657,702 | A * | 8/1997 | Ribeyrolles | 108/61 |
| 5,971,173 | A * | 10/1999 | Valiulis et al. | 211/184 |
| 6,047,647 | A * | 4/2000 | Laraia, Jr. | 108/61 |
| 6,685,037 | B1 * | 2/2004 | Zadak | 211/184 |
| 6,991,307 | B2 * | 1/2006 | Hoenig | 312/348.3 |

(Continued)

*Primary Examiner* — Joshua J Michener
*Assistant Examiner* — Devin Barnett
(74) *Attorney, Agent, or Firm* — Reinhart Boerner Van Deuren P.C.

(57) ABSTRACT

A stand alone divider for a shelf is provided. The stand alone divider includes a first and a second retainer arranged to grip a first and a second edge of a shelf. The stand alone divider may be installed on and removed from a shelf without the use of tools. The stand alone divider may have an adjustable length.

11 Claims, 11 Drawing Sheets

(56) References Cited

U.S. PATENT DOCUMENTS

| | | | | |
|---|---|---|---|---|
| 8,016,139 | B2 * | 9/2011 | Hanners et al. | 211/184 |
| 8,104,630 | B2 * | 1/2012 | Schneider | 211/184 |
| 8,333,284 | B2 * | 12/2012 | Berry et al. | 211/55 |
| 2003/0132178 | A1 * | 7/2003 | Jay et al. | 211/59.2 |
| 2004/0226207 | A1 * | 11/2004 | Fast et al. | 40/661.03 |
| 2006/0075670 | A1 * | 4/2006 | Brinkman | 40/666 |
| 2006/0260518 | A1 * | 11/2006 | Josefsson et al. | 108/61 |
| 2010/0252517 | A1 * | 10/2010 | Grobbelaar | 211/134 |
| 2010/0252519 | A1 * | 10/2010 | Hanners et al. | 211/184 |
| 2012/0066948 | A1 * | 3/2012 | Martin et al. | 40/611.06 |

* cited by examiner

STAND ALONE DIVIDER FOR SHELVING

FIELD OF THE INVENTION

This invention generally relates to retail displays, and more particularly to dividers for shelves.

BACKGROUND OF THE INVENTION

In the display of retail merchandise, it is common to use long shelves to display many different articles of merchandise. In order to adequately separate this merchandise, shelf dividers are used to define areas having discreet boundaries for each particular product. Such dividers are typically rigid, wall-like structures that extend generally perpendicular to the supporting surface of a merchandise shelf.

Typically, shelf dividers are attached to a shelf by one or more semi-permanent methods. For example, one method involves inserting tabs attached to the divider into apertures formed through the shelf. Tools are then needed to pry these tabs free during removal of the divider. Another method includes the use of an adhesive, which may also require tools as well as cleaning solution to remove the shelf divider. Other types of dividers require fasteners such as screws or bolts for their attachment, and thus also require the use of tools to install and remove the same.

All of the aforementioned methods of installation are semi-permanent to the extent that there is a significant amount of time and labor required to uninstall the dividers once installed. As such, the aforementioned dividers limit the flexibility of retailers to frequently and rapidly update their merchandise displays. Also, installing, moving, or removing the dividers causes shelving space down time, during which the retailer cannot display any merchandise. Accordingly, there exists a need in the art for a divider which can be installed on and removed from retail shelving in a rapid and low cost manner This invention provides such a divider. This and other advantages of the invention, as well as additional inventive features, will be apparent from the description of the invention provided herein.

BRIEF SUMMARY OF THE INVENTION

In one aspect, a stand alone divider for a shelf is provided. An embodiment according to this aspect includes a partition, a back retainer proximate a back end of the divider, and a front retainer proximate a front end of the divider. At least one of the front and back retainers is resiliently flexible relative to the partition between a relaxed state and an extended state, such that a distance between a retaining clip of the at least one retainer and the partition is selectively variable for mounting the stand alone divider.

In a more particular embodiment, at least one of the front and back retainers of the stand alone divider includes a clip configured to undercut a lip of the shelf when installed thereon. A hinge portion of the at least one of the front and back retainers connects the at least one of the front and back retainers to the partition, and a leg portion extends from the hinge portion and spaces and connects the clip to the hinge portion such that the clip is pivotable forward and rearward relative to the partition.

In a more particular embodiment, a vertical post extends upwardly from the leg portion of the at least one of the front and back retainers, the vertical post being parallel to a proximate edge of the partition, such that an upwardly opening slot is formed between the vertical post and the proximate edge of the partition.

In another embodiment, the partition of the stand alone divider includes a barrier and a base perpendicular to the bottom edge of the barrier, the base having a width greater than the thickness of the barrier.

In another embodiment, the clip of at least one retainer has a groove adapted to receive an elastic member such as an elastic band, an o-ring, or a gasket. In a more particular embodiment, the clip has an elastic member attached thereto.

In yet another embodiment, the partition is a two-part assembly having an adjustable length. In a more particular embodiment, the partition having an adjustable length includes a first member, a second member, and a pawl mechanism formed between the first and second members. The pawl mechanism is operable to lock the first member relative to the second member and vice versa to define an adjusted length of the partition. The second member is sized to be received within a channel of the first member. The pawl is formed on the first member, and the rack is formed on the second member.

In another embodiment of a stand alone divider with a two-part partition having an adjustable length, the partition includes a first member including a first plurality of interlocking structures and a first plurality of apertures, and a second member including a second plurality of interlocking structures and a second plurality of apertures. At least one of the first plurality of interlocking structures is resiliently received in at least one of the second plurality of apertures. At least one of the second plurality of interlocking structures is resiliently received in at least one of the first plurality of apertures.

In a more particular embodiment, the interlocking structures of both the first and second partition members include crescent shaped tabs extending from respective sides of the first and second partition members.

In another aspect, a retail display configuration is provided. An embodiment according to this aspect includes a shelf and at least one stand alone divider. The shelf extends horizontally, has a front and a back edge, and has a top wall extending between a merchandise display surface and an underside surface. A front lip is formed at the front edge of the shelf, and a back lip is formed at the back edge of the shelf. The at least one stand alone divider includes a partition, a back retainer, proximate a back end of the partition, adapted to mount to the shelf at the back lip, and a front retainer, proximate a front end of the partition, adapted to mount to the shelf at the front lip. At least one of the front and back retainers has a clip configured to undercut the shelf such that a portion of the clip contacts the underside surface of the shelf when installed thereon.

In a more particular embodiment, at least two stand alone dividers are mounted parallel to each other on the shelf, forming spaces therebetween.

In a more particular embodiment, a vertical post extends upwardly from at least one of the front and back retainers. The vertical post being parallel to a proximate edge of a partition, and forming an upwardly opening slot therewith.

In a more particular embodiment, the retail display configuration includes two adjacent stand alone dividers and a front stop, wherein the front stop is received in the slots of the two adjacent stand alone dividers such that a merchandise display space is bounded by the merchandise surface, the front stop, and the two adjacent stand alone dividers.

In another embodiment, the partition of at least one stand alone divider comprises a barrier and a base perpendicular to the bottom edge of the barrier, the base having a width greater than the thickness of the barrier.

In another embodiment, a clip of the at least one of the front and back retainers has a groove adapted to receive an elastic member such as an o-ring. In a more particular embodiment, a clip of at least one retainer has an elastic band attached thereto.

In another embodiment, the partition of at least one stand alone divider is a two-part assembly having an adjustable length. In one more particular embodiment, the partition includes a first member, a second member, and a pawl mechanism formed between the first and second members. The pawl mechanism includes a rack and a locking structure. The pawl is formed on the first member, and the rack is formed on the second member. The second member is sized to be received within a channel of the first member.

In another particular embodiment of a partition having an adjustable length, the partition includes a first member with interlocking structures along a side thereof, and a second member with interlocking structures along a side thereof The interlocking structures of the first member interlock with the second member, and the interlocking structures of the second member interlock with the first member. In a more particular embodiment, the interlocking structures include crescent shaped tabs extending from respective sides of the first and second members.

In another aspect, a method of installing a stand alone divider for a shelf is provided. An embodiment of a method according to this aspect includes inserting a first lip of a shelf into a gripping slot in a first retainer of the stand alone divider. The method also includes pulling a second retainer past an equilibrium position and past a second lip of the shelf, causing the second retainer to flex open. The method also includes returning the second retainer approximately to its equilibrium position such that the second lip of the shelf is gripped by a gripping slot in the second retainer.

In a more particular embodiment, a method of installing a stand alone divider for a shelf, the steps of inserting, pulling, and returning are preceded by a step of adjusting the length of a partition member of the stand alone divider to match a length of the shelf In a more particular embodiment, a method of adjusting the length of the partition member, the partition member is locked into place after it is adjusted.

In a more particular embodiment, a method of locking the partition member, locking the partition at an adjusted length comprises the step of engaging a pawl mechanism on a first member of the partition with a rack on a second member of the partition.

In another embodiment, a method of locking the partition member, locking the partition at an adjusted length comprises the step of interlocking at least one tab on a first member of the partition with at least one aperture and on a second member of the partition.

In another embodiment, a method of installing a stand alone divider on a shelf, the steps of inserting, pulling, and returning are repeated for a second stand alone divider. In a more particular method of installing a stand alone divider on a shelf, the second stand alone divider is spaced laterally from the first stand alone divider and is mounted on the same shelf as the first stand alone divider. In a more particular method of installing a stand alone divider on a shelf, a first end of a front stop is inserted in a first upwardly opening slot in the first stand alone divider and a second end of the front stop is inserted in a second upwardly opening slot in the second stand-alone divider.

In another aspect, an embodiment of the stand alone divider includes a first partition member and a second partition member. The second partition member is slidable relative to the first partition member and there is a resilient member positioned on at least one of the first and second partition members such that a portion of the at least one of the first and second partition members is resiliently flexible relative to the other one of the first and second partition members to selectively increase a length of the stand alone divider.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Turning now to the drawings, embodiments of the present invention provide a stand alone divider that can be rapidly installed on a retail shelf without the use of additional tools. Accordingly, the disadvantages of prior designs regarding cost of installation and retail display down time are significantly reduced or entirely overcome. FIGS. 1-4 illustrate a first embodiment of a stand alone divider 10.

Figure 1:
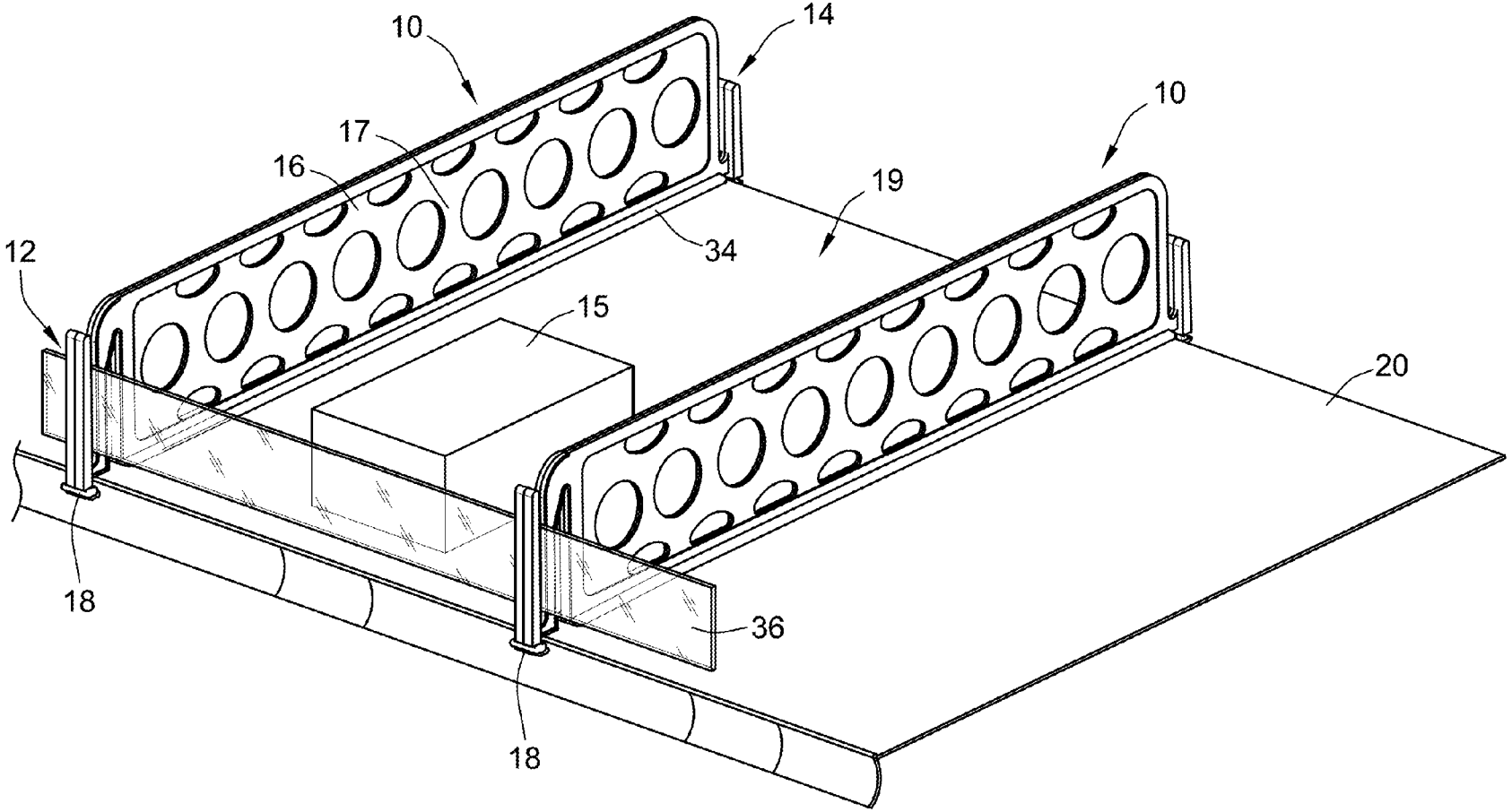
FIG. 1 is a perspective illustration of a first embodiment of two stand alone dividers according to the teachings of the present invention, installed on a shelf.

In particular, FIG. 1 depicts two stand alone dividers 10 installed on a top surface of a shelf 20. The stand alone dividers are laterally spaced along the shelf 20, creating a first and a second boundary of a retail merchandise containment area 19 that will effectively segregate the merchandise 20 therein from other merchandise on the shelf 20 not within the merchandise containment area 19. A front stop 36 provides a third boundary for the merchandise containment area 19, preventing merchandise 15 from falling off the front of the shelf 20. As shown at FIG. 1 and as will be described in greater detail below, the front stop 36 is mounted directly to the stand alone dividers 10 such that no additional hardware is required to mount the front stop 36.

Each stand alone divider is generally comprised of a partition 16, a front retainer 12 proximate a front end of the partition 16, and a back retainer 14 proximate a back end of the partition 16. It will be recognized that the terms "front" and "back" are used for illustrative purposes only, and the particular structure of the front retainer 12 can be positioned at the other end of the partition 16 in other embodiments. The same is true for the back retainer 14. Further, although illustrated as utilizing different retainers 12, 14, other embodiments can incorporate two back retainers 12 or two front retainers 14 at opposite ends of the partition 16. Further, the front stop 36 may be mounted to either the front retainer 12 or the back retainer 14, such that the front stop 36 may provide a boundary for the merchandise display area 19 at one or both of the front and back of the shelf 20, regardless of which of the front and back retainers 12, 14 are selected and their positioning relative to the front and back of the shelf 20.

Still referring to FIG. 1, the partition 16 is comprised generally of a base 34 and a barrier 17 extending upwardly from the base 34. The base 34 has a width greater than the thickness of barrier 17, such that the partition 16 is generally "T" shaped at its cross section. The increased width of base 34 reduces the likelihood that divider 10 will tip over during use, and generally promotes the stability of the same.

Figure 2:
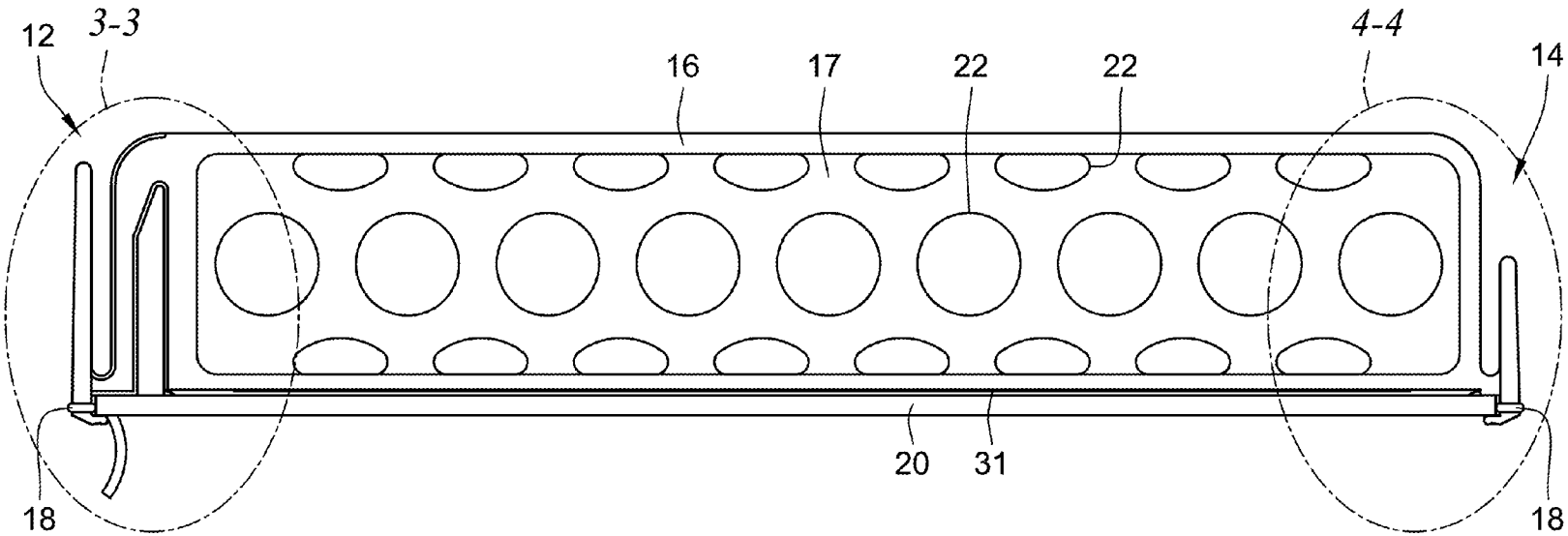
FIG. 2 is a side view of one of the stand alone dividers shown in FIG. 1.

Turning now to FIG. 2, a side view of the stand alone divider 10 of FIG. 1 is depicted. The front retainer 12 grips a front edge or lip of the shelf 20, and the back retainer 14 grips a back edge or lip of the shelf 20. The length of the partition 16 is substantially the same length as the length of the shelf 20 such that the front and back retainers 12, 14 extend beyond the shelf 20 and grip the shelf 20 respectively at the front and back ends thereof.

As will be explained below, o-rings 18 are installed on the front and back retainers 12, 14 to increase friction between the divider 10 and the shelf 20, thereby reducing the ability of the divider 10 to move laterally along the shelf 20.

The barrier 17 includes various apertures 22 to reduce material costs and increase rigidity; however, many other patterns of apertures or types of apertures, or no apertures, may be used.

Figure 3:
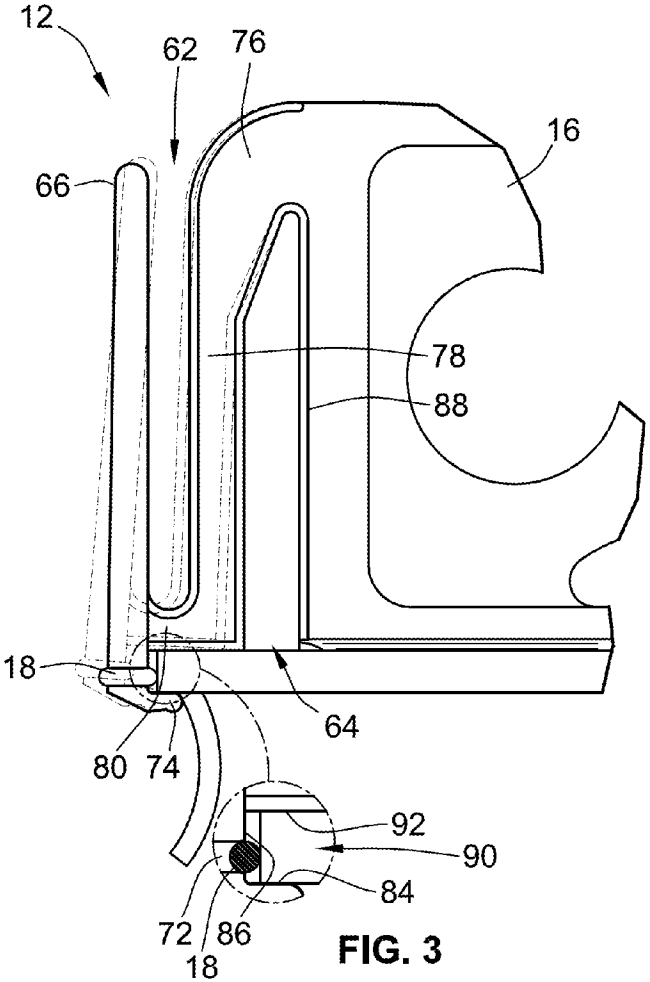
FIG. 3 is a side view of a one retainer utilized on the stand alone dividers of FIG. 1.

Turning now to FIG. 3, a side view of the front retainer 12 is depicted and will be discussed in detail. A leg portion 78 of the front retainer 12 is fixedly connected to the partition 16 by a first resiliently flexible hinge portion 76. The leg portion 78 forms a downwardly opening slot 64 with the front edge 88 of the partition 16. A vertical post 66 extends from an end of the leg portion 78, and includes a retaining clip 74 formed at an end thereof. An upwardly opening slot 62 is formed between the leg portion 78 and the vertical post 66. The vertical post 66 joins the end of the leg portion 78 at a second resiliently flexible hinge portion 80 at an end of the leg portion 78 that spaces the retaining clip 74 and the vertical post 66 from the leg portion 78. The upwardly opening slot 62 may receive a panel such as the front stop 36 (see FIG. 1).

The retaining clip 74 has a groove 72, which may accept an elastic band such as the aforementioned o-rings 18 (see FIG. 2) or a gasket. The retaining clip 74 may also be co-molded with an elastic material at the groove 72 such that the retaining clip 74 is a multi-material structure. An elastic band or a gasket can also be used in place of the o-ring 18 in other embodiments. The retaining clip 74 has an upward facing surface 84 that is perpendicular to a rearward facing surface 86 of the vertical post 66, which, together with a bottom edge 92 of the second hinge portion 80, form a gripping slot 90.

The gripping slot 90 is configured to grip a front lip of the shelf 20 (see FIG. 2) via the close reception thereof As illustrated, the o-ring 18 installed on the retaining clip 74 frictionally contacts a front face of the shelf 20 at the lip to limit any lateral sliding of the stand alone divider 10 as discussed above. Additionally, an upward facing surface 84 contacts or "undercuts" the front lip of the shelf 20 such that it contacts an underside thereof or is at least in close proximity thereto. The aforementioned contact between the front lip of the shelf 20 and the gripping slot 90 securely fastens the front retainer 12 to the shelf 20.

Figure 4:
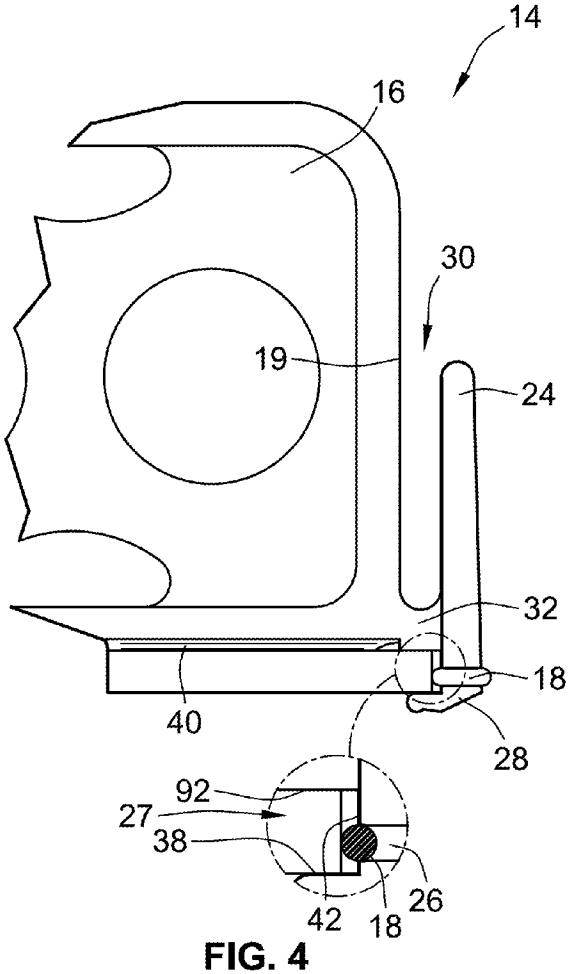
FIG. 4 is a side view of another retainer utilized on the stand alone dividers of FIG. 1.

With reference to FIG. 4, a side view of the back retainer 14 is depicted and will be discussed in detail. The back retainer 14 includes a vertical post 24 with a retaining clip 28 formed at an end thereof. The vertical post 24 forms an upwardly opening slot 30 with the back edge 19 of the partition 16. The back retainer 14 includes a hinge portion 32 that spaces and connects the remainder of the back retainer 14 (and more specifically the vertical post 24) to the partition 16. Similarly to the front retainer 12, the upwardly opening 30 slot of the back retainer 14 may receive a panel such as the front stop 36.

The retaining clip 28 has a groove 26, which is configured to receive an elastic member such as an elastic band, o-rings 18 (see FIG. 2), or a gasket. The retaining clip 28 may also be co-molded with an elastic material at the groove 26 such that the retaining clip 28 is a multi-material structure. The retaining clip 28 has an upward facing surface 38 that is perpendicular to a forward facing surface 42 of the vertical post 24, which, together with the bottom edge 40 of the partition 16, form a gripping slot 27.

The gripping slot 27 is configured to grip a back lip of the shelf 20 (see FIG. 2) via the close reception thereof As illustrated, the o-ring 18 installed on the retaining clip 28 and frictionally contacts a front face of the shelf 20 at the lip to limit any lateral sliding of the stand alone divider 10 as discussed above. Additionally, the upward facing surface 42 contacts or "undercuts" the back lip of the shelf 20 such that it contacts an underside thereof or is at least in close proximity thereto.

Turning now to FIGS. 5-8, an alternate embodiment 110 of a stand alone divider is shown. Many features of the stand alone divider 110 are substantially similar to those of stand alone divider 10 (e.g. a front and a back retainer 112, 114, apertures 124, 180, and the types of material suitable for constructing the stand alone divider 110, etc), and to avoid redundant disclosure, only the differences are discussed below.

Figure 5:
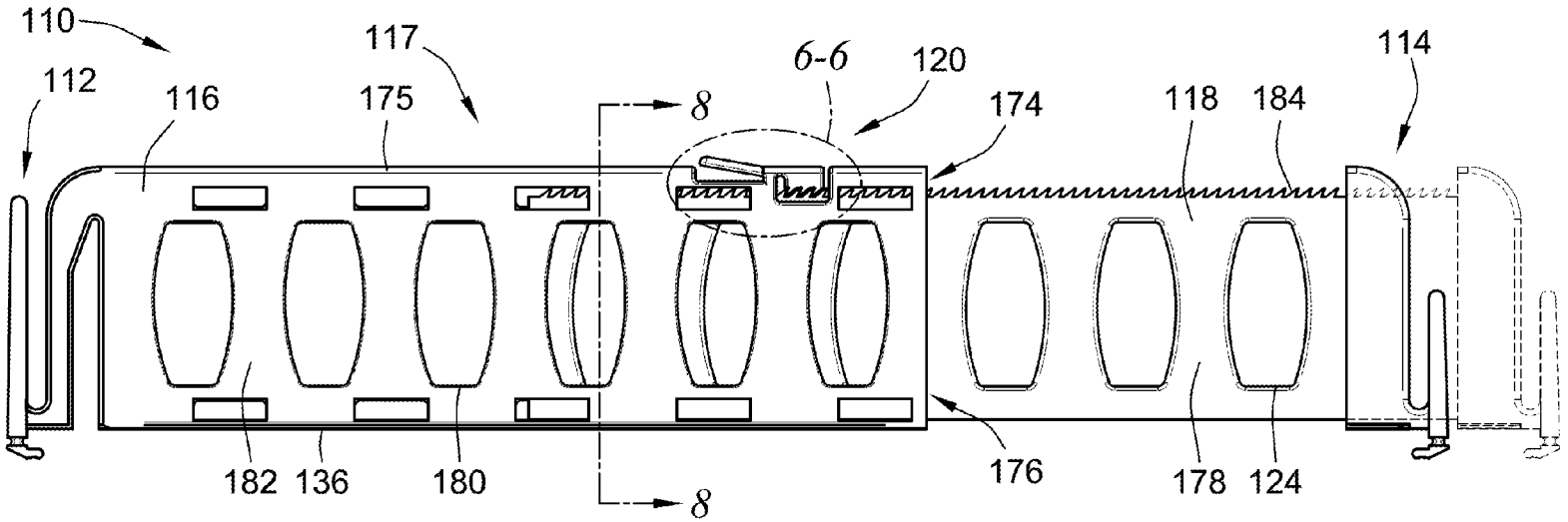
FIG. 5 is a side view of a second embodiment of a stand alone divider having an adjustable length.

With particular reference to FIG. 5, the partition 117 of the stand alone divider 110 has an adjustable length, and includes a first partition member 116 and a second partition member 118. As will be explained in greater detail below, the first and second partition members 116, 118 are slidable relative to one another to achieve the aforementioned adjustability.

The first partition member 116 is comprised of a base 136 with a barrier 182 extending upwardly from the base 136. A top channel 174 is formed along the top of the barrier 182, and a bottom channel 176 is formed along the base 136. This embodiment also includes a pawl mechanism 120 formed between the first and second partition members 116, 118 with a lever 152 and locking structure 154 thereof formed along a top wall 175 of the top channel 174.

The second partition member 118 is comprised of a barrier 178 and a rack 184 of the pawl mechanism 120. The rack 184 is formed on the top edge of the barrier 178. The second partition member 118 is sized to be received within the top channel 174 and the bottom channel 176 of the first partition member 116, and is slidably adjustable relative thereto, to selectively adjust the length of the partition 117. This allows the divider 110 to accommodate shelves of various depths.

In FIG. 5, the rack 184 is depicted extending the length of the top edge of the barrier 178 of the second partition member 118; however, the rack 184 may extend over a smaller length of the top edge of the barrier 178.

Figure 6:
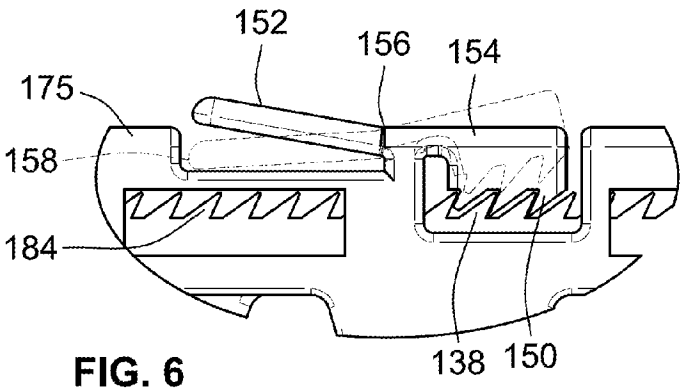
FIG. 6 is a side view of a pawl and rack mechanism utilized in the stand alone divider of FIG. 5.

Next, in FIG. 6, a side view of the engaged pawl mechanism 120 is depicted. The pawl mechanism 120 includes the lever 152 and a locking mechanism 154 introduced above, which are fixedly connected at hinge 156 to the first partition member 116. When the pawl mechanism 120, and more particularly the lever 152 and locking structure 154, is/are in a relaxed state as shown by the solid lines at FIG. 6, one or more teeth 150 of locking structure 154 engage one or more teeth 138 of rack 184, helping to prevent movement of the second partition member 118 within the top channel 174 and bottom channel 176 in a direction parallel to a longitudinal axis of the first partition member 116.

When the lever 152 is in a depressed position 158, hinge 156 causes locking mechanism 154 to move to a raised position shown in dashed lines at FIG. 6 at which position the teeth 150 of the locking structure 154 no longer engage with the teeth 138 of rack 184. This allows movement of second partition member 118 in a direction parallel to first partition member 116 in order to adjust the overall length of the partition. This allows the stand alone divider 110 to accommodate shelves of various lengths.

Although the locking mechanism 154 has three teeth 150 as shown, it may have more or less teeth in other embodiments.

Figure 7:
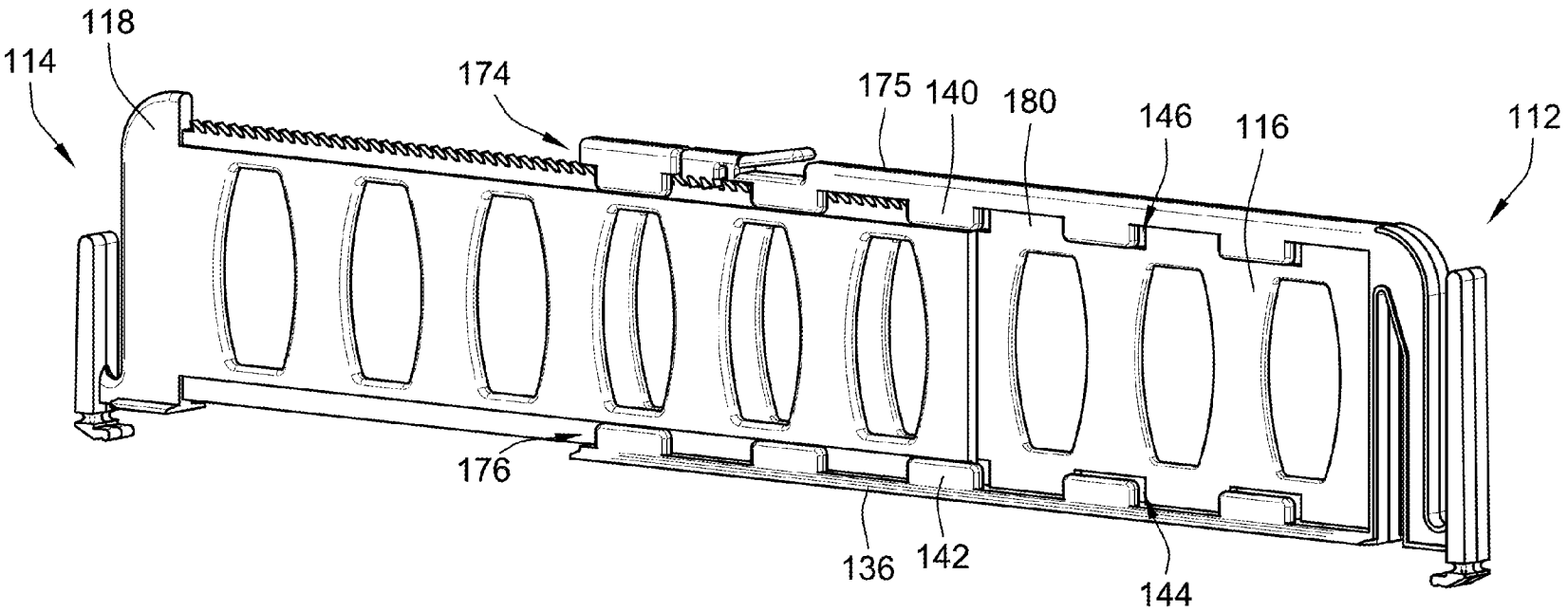
FIG. 7 is a perspective view of the stand alone divider of FIG. 5.

With reference to FIG. 7, a perspective view illustrating the top channel 174 and the bottom channel 176 of the first partition member 116 is shown. The top channel 174 is formed on one side by the barrier 180, wherein the barrier 180 has regularly spaced apertures 146, on a second side by the top wall 175, and on a third side by downwardly extending tabs 140, wherein the downwardly extending tabs 140 are fixedly connected at their top edges to the top wall 175.

Similarly, the bottom channel 176 is bordered on one side by the barrier 180, wherein the barrier 180 has regularly spaced apertures 144, on a second side by the base 136, and on a third side by upwardly extending tabs 142, wherein the upwardly extending tabs 140 are fixedly connected at their bottom edge to the base 136.

Figure 8:
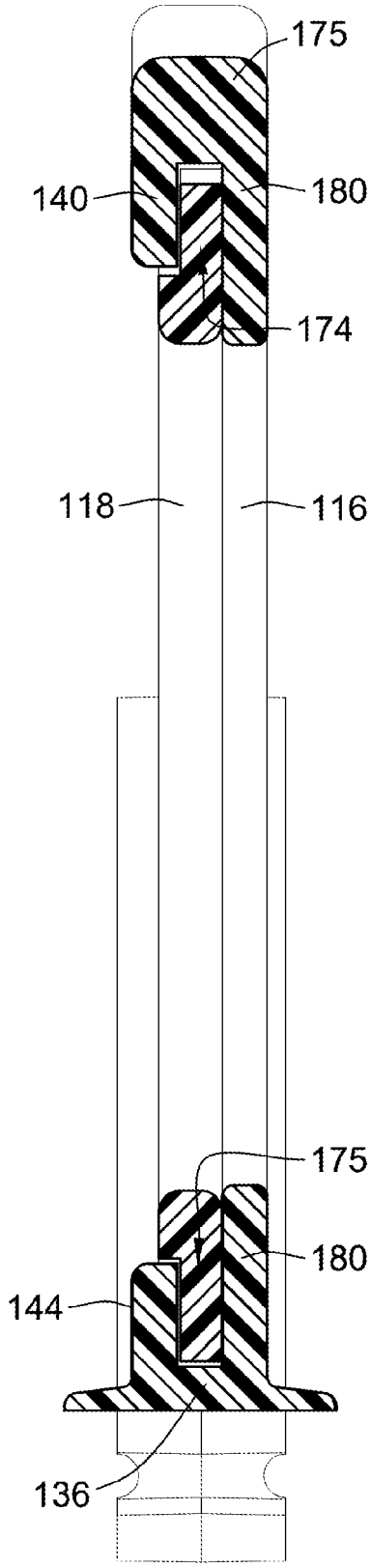
FIG. 8 is a front view of a cross-section of the stand alone divider of FIG. 5.

Turning now to FIG. 8, a cross sectional area of stand alone divider 110 is shown, illustrating that the second partition member 118 is received within the channels 174, 176 of first partition member 116. The second partition member 118 is surrounded at its top edge within the top channel 174 on one side by the barrier 180, and on an opposite side by the tabs 140, with the top wall 175 extending between the tabs 140 and the barrier 180. Similarly, the second partition member 118 is surrounded at its bottom edge within the bottom channel 176 on one side by the barrier 180, on an opposite side by the tabs 144, with the base 136 extending between the tabs 144 and the barrier 180.

The top and bottom channels 174 and 176 reduce the ability of the second partition member 116 to move in any direction except a direction parallel a longitudinal axis of the first partition member 118.

It will be recognized from inspection of FIGS. 5-8 that this embodiment of the stand alone divider 110 also incorporates front and back retainers 112, 114 that are the same as those described above relative to FIGS. 1-5 (see retainers 12, 14). Thus, in addition to advantageously providing an adjustable length, this embodiment also provides for the rapid and low cost installation and removal of the stand alone divider 110 via the provision of flexible front and back retainers.

Turning next to FIGS. 9-14, yet another alternate embodiment 210 of a stand alone divider is shown. Many features of this alternate stand alone divider 210 are substantially similar to those of the previous embodiments 10 and 110 (e.g. adjustable length, retaining members 212, 214, barriers 280, 290, and bases 282, 292, portion relative dimensions, and materials suitable for the construction of the stand alone divider 210, etc.), and to avoid redundant disclosure, only the differences are hereinafter discussed.

Figure 9:
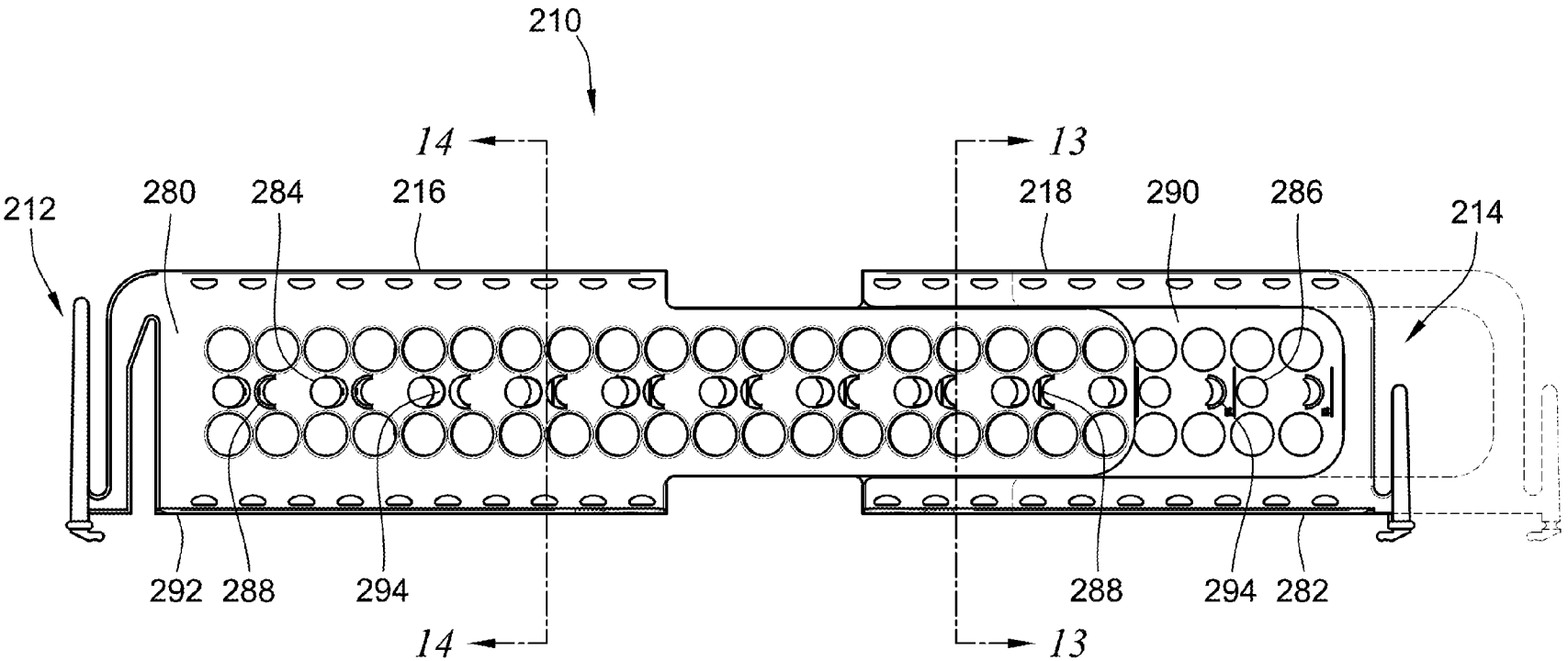
FIG. 9 is a side view of a third embodiment of a stand alone divider, having an adjustable length.

With particular reference now to FIG. 9, this stand alone divider 210 also has an adjustable length. More specifically, the illustrated stand alone divider 210 includes first and second partition members 216, 218 that are adjustable relative to one another. Each of the first and second partition members 216, 218 also include respective interlocking structures 288, 294. The interlocking structures 288, 294 function to lock the first and second partition members 216, 218 relative to one another once a user has adjusted the stand alone divider 210 to a specific desired length. The interlocking structures 288 of the first partition member 216 are received in apertures 286 of the second partition member 218. Likewise, the interlocking structures 294 of the second partition member are received in apertures 284 of the first partition member 216.

Figure 10:
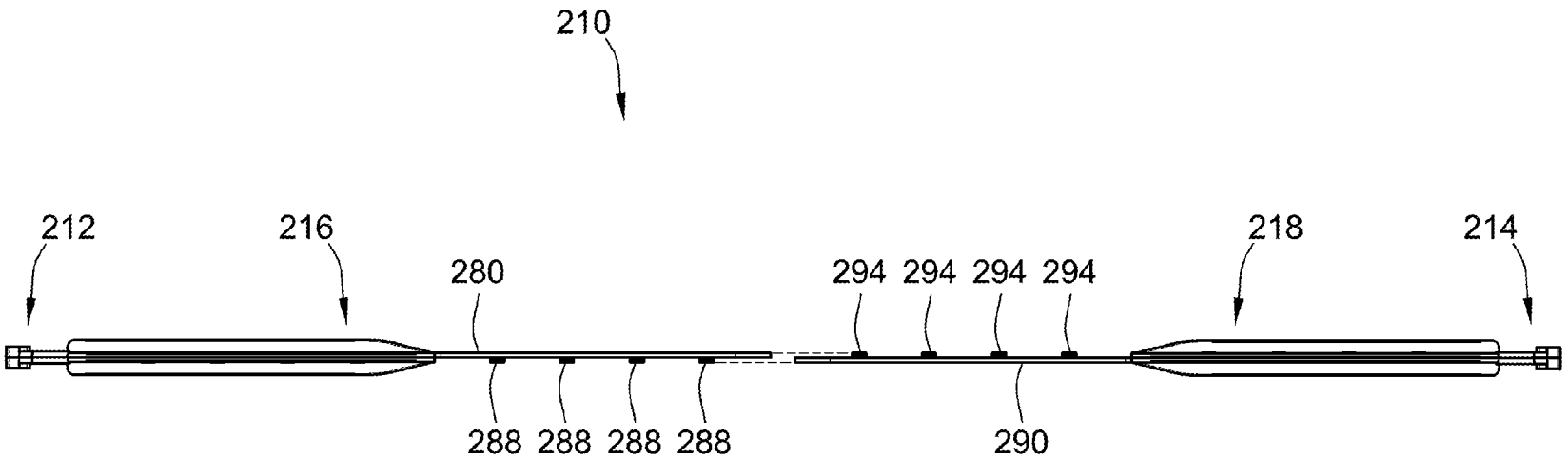
FIG. 10 is an exploded top view of the stand alone divider of FIG. 9.

Turning now to FIG. 10, the interlocking structures 288 of the first partition member 216 are regularly spaced and extend away from the barrier 280 portion thereof, such that they extend generally perpendicular to a longitudinal axis of the first partition member 216. The interlocking structures 288 of the first partition member 216 extend laterally outward and toward the second partition member 218.

The interlocking structures 294 of the second partition member 218 are regularly spaced and extend away from the barrier 290 portion thereof, such that they extend generally perpendicular to a longitudinal axis of the second partition member 218. The interlocking structures 294 of the second partition member 218 extend laterally outward and toward the first partition member 216. As can be seen from inspection of FIG. 10, the first and second partition members 216, 218 are essentially mirror images of one another and are essentially symmetric about the longitudinal axis of the stand alone divider 210, save for the differences in the retaining members 212, 214.

Figure 11:
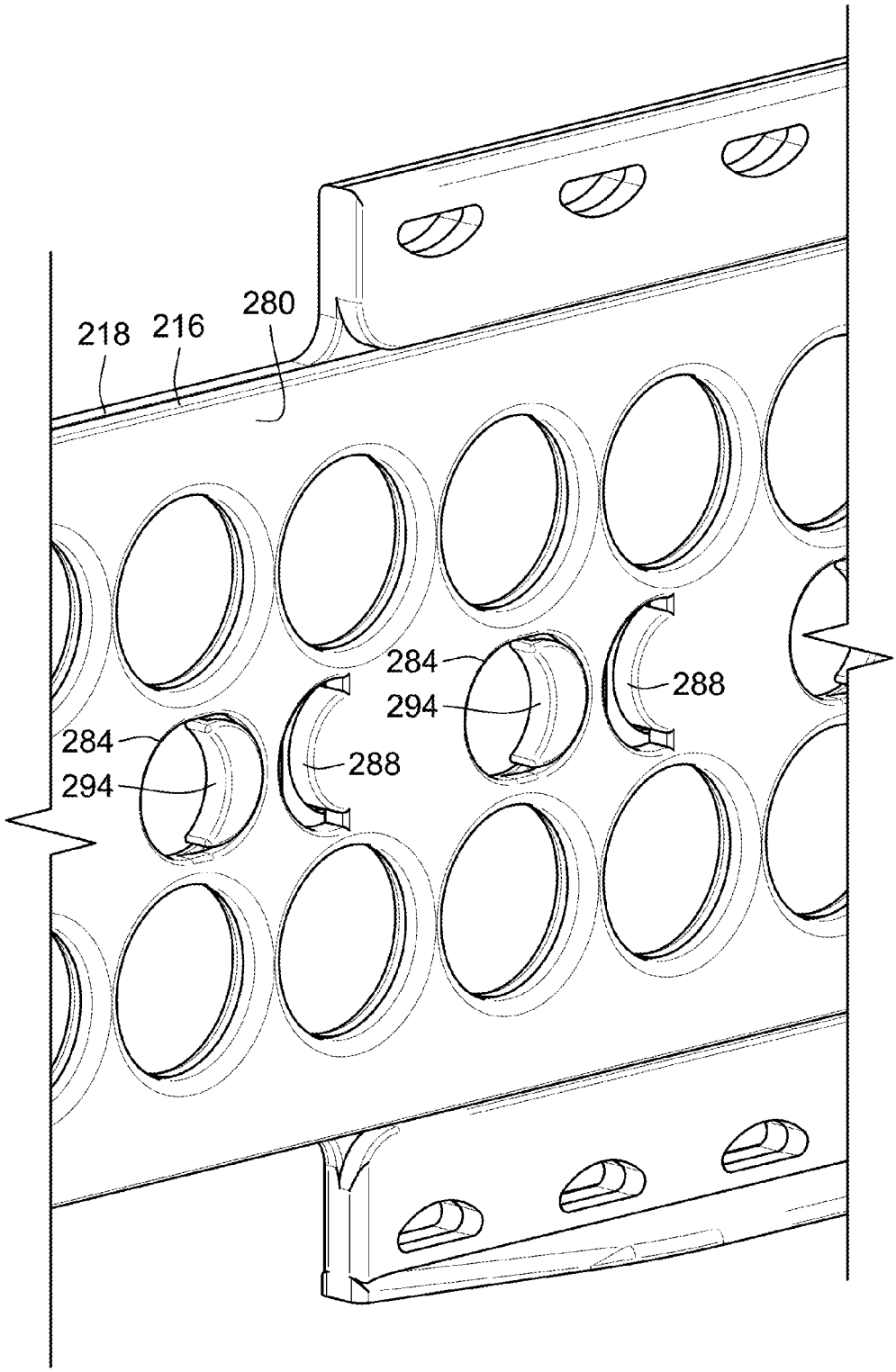
FIG. 11 is a perspective view of a first side of an interlocking mechanism utilized in the stand alone shelf divider of FIG. 9 in an interlocked position.
Figure 12:
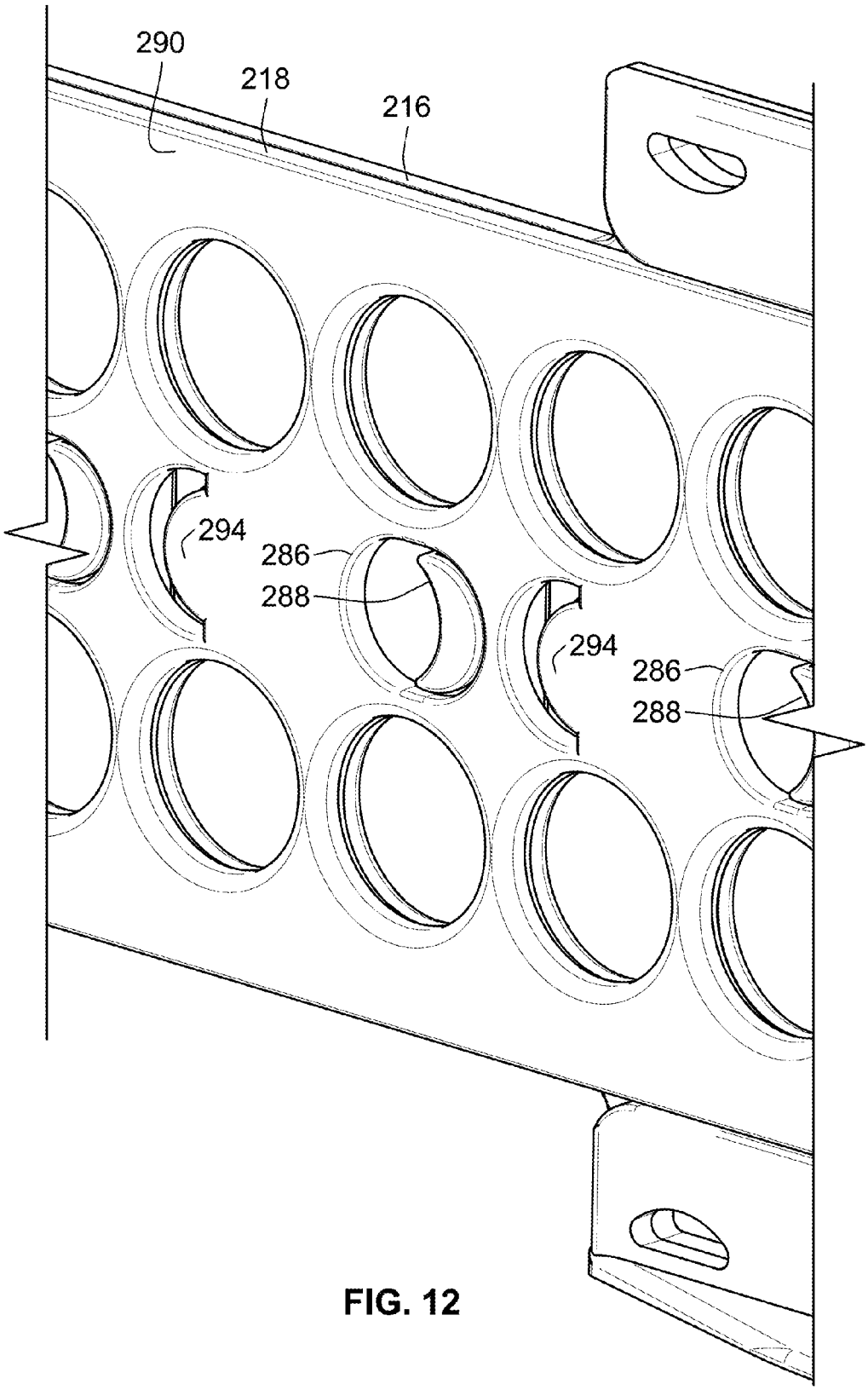
FIG. 12 is a perspective view of a second side of an interlocking mechanism utilized in the stand alone shelf divider of FIG. 9 in an interlocked position.

With reference now to FIGS. 11 and 12, the particular respective interaction of the interlocking structures 288, 294 with the apertures 286, 284 will be described in greater detail. FIG. 11 in particular shows the interlocking structures 294 of the second partition member 218 seated within the apertures 284 of the first partition member 216. The interlocking structures 294 of the second partition member 218 have a generally semi-circular outer periphery similar to or the same as the circular shape of the apertures 284 extending through the barrier 280 of the first partition member 216. As a result, the interlocking structures 294 of the second partition member seat within the apertures 284 of the first partition member 216 so as to prevent relative movement between the first partition member 216 and the second partition member 218.

The interlocking structures 294 of the second partition member 218 seat within the apertures 284 via a resilient snap connection such that once the interlocking structures 294 are pushed into their respective apertures 284, the same will not freely separate therefrom without a sufficient amount of force applied to the interlocking structures 294 in a direction perpendicular to the longitudinal axis of the stand alone divider 210.

FIG. 12 in particular shows the interlocking structures 288 of the first partition member 216 seated within the apertures 286 of the second partition member 218. The interlocking structures 288 of the first partition member 216 have a generally semi-circular outer periphery similar to or the same as the circular shape of the apertures 286 extending through the barrier 290 of the second partition member 216. As a result, the interlocking structures 288 of the first partition member seat within the apertures 286 of the second partition member 218 so as to prevent relative movement between the first partition member 216 and the second partition member 218.

The interlocking structures 288 of the second partition member 218 seat within the apertures 286 via a resilient snap connection such that once the interlocking structures 288 are pushed into their respective apertures 286, the same will not freely separate therefrom without a sufficient amount of force applied to the interlocking structures 288 in a direction perpendicular to the longitudinal axis of the stand alone divider 210.

Those skilled in the art will immediately recognize that the particular shape of the interlocking structures 288, 294 and apertures 286, 284 are not limited in any way to that illustrated. Indeed, various geometries may be utilized to achieve the tab and slot type connection formed by these structures.

Figure 13:
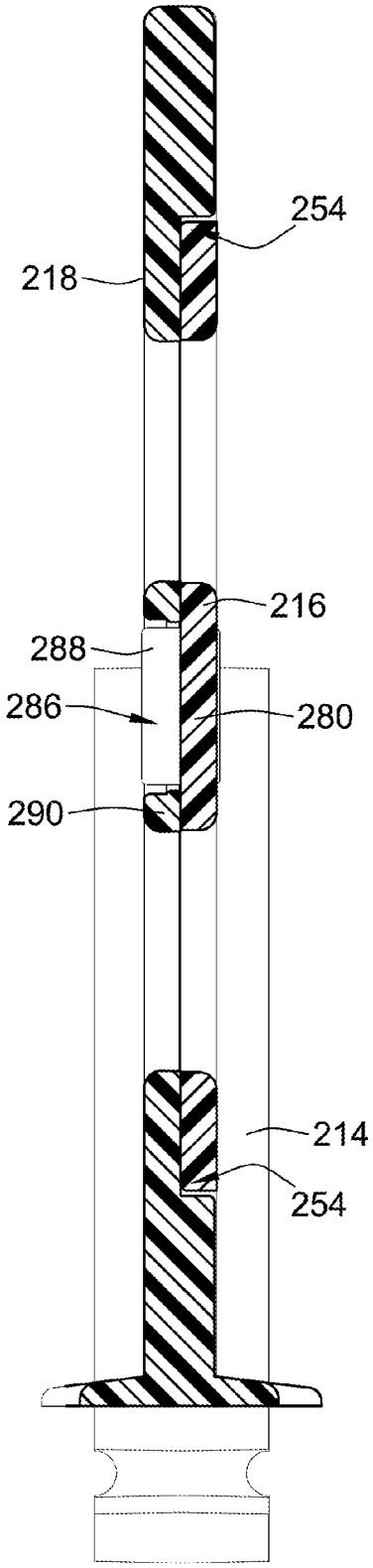
FIG. 13 is a cross-sectional view of a one end of the stand alone shelf divider of FIG. 9.
Figure 14:
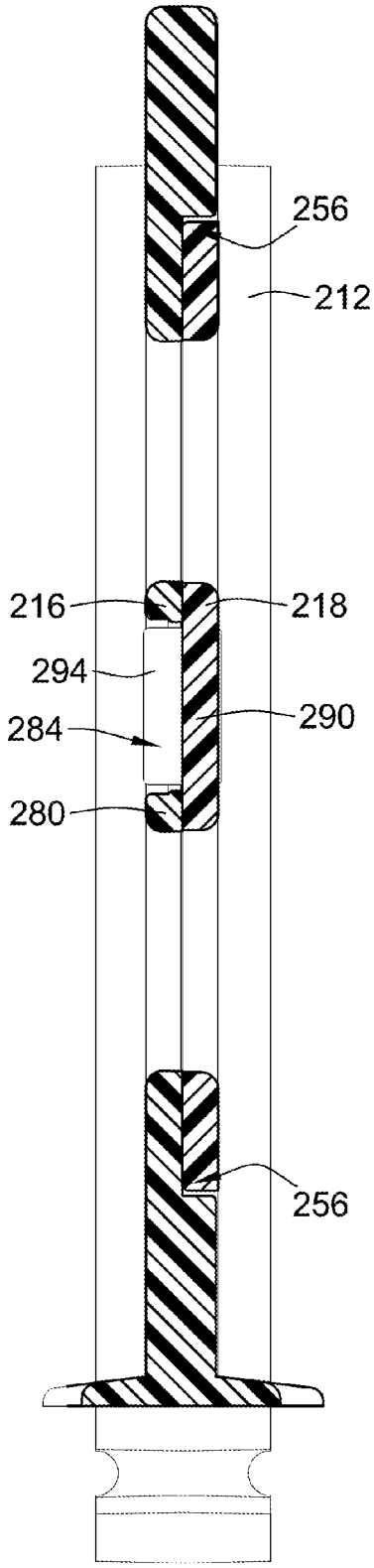
FIG. 14 is a second cross-sectional view of another end of the stand alone shelf divider of FIG. 9.

With reference now to FIGS. 13 and 14, the close reception of the first partition member 216 by the second partition member 218 and vice versa will be described. FIG. 13 in particular shows a cross section of the first and second partition members 216, 218 when interlocked. The first partition member 216 is received within a channel 254 of the second partition member 218. FIG. 14 in particular also shows a cross section of the first and second partition members 216, 218 when interlocked. The second partition member 218 is received within a channel 256 of the first partition member 216. As can be seen from inspection either of FIG. 13 or FIG. 14, incorporation of the channels 254, 256 allows the stand alone divider 210 to advantageously have a constant width proximate the barrier portions 280, 290 when the first and second partition members 216, 218 are overlapped and interlocked.

In both of the adjustable length embodiments described above, in an alternate configuration that does not incorporate flexible retainers 112, 212, 114, 214, a resilient member such as a flexible band can be connected between the first and second partition members 116, 216, 118, 218. As the first partition member 116, 216 is pulled away from the second partition member 118, 218, a biasing force generated by the flexible band operates to bias the first partition 116, 216 back towards the second partition 118, 218. As a result, the first partition member 116, 216 can be pulled away from the second partition member 118, 218 to trap the front and back lips of a retail shelf in the retainers 112, 212, 114, 214.

Having described the structural attributes of several embodiments of the instant invention, the installation process of these embodiments will now be described. Referring to the figures generally, to install the stand alone divider 10, 110, 210, the back retainer 14, 114, 214 is first hooked or clipped at the back end of the shelf such that the retaining clip thereof (see e.g. retaining clip 28 at FIGS. 1-5) undercuts the edge of the shelf and the same is positioned within the gripping slot (see e.g. gripping slot 27 at FIGS. 1-5) of the back retainer 14, 114, 214.

Thereafter, and with particular reference to FIG. 4, the front retainer 12 may be pulled past its equilibrium position (shown in solid lines) to an extended position (shown in dashed lines), such that the first hinge 76 flexes and the downwardly opening slot 64 widens. As the front retainer 12 is then relaxed approximately to its equilibrium position 68, the gripping slot 90 can be positioned around the second edge of the shelf 20. The first and second edges of the shelf 20 are thus gripped within the gripping slots 27 and 90, such that the ability of the stand alone divider 10 to freely move relative to the shelf 20 is reduced or prevented entirely. Thus, the installation of the stand alone divider 10 on a shelf 20 may be completed without the use of tools or fasteners.

In the adjustable embodiment shown at FIGS. 5-8, prior to performing the above retainer 112, 114 mounting steps, the stand alone divider 110 can be adjusted to a particular length by depressing lever 152, sliding the second partition member 118 relative to the first partition member 116 or vice versa, and releasing the lever 152 to engage the pawl mechanism 120. It will be recognized that this step of adjustment could also be performed after installing the back retainer 114 as described above.

In the adjustable embodiment shown at FIGS. 9-14, prior to performing the above retainer 212, 214 mounting steps, the stand alone divider 210 can be adjusted to a particular length by connecting the first partition member 216 to the second partition member 218 via the snap connection as described above. It will be recognized that this step of adjustment could also be performed after installing the back retainer 114 as described above.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A stand alone divider for a shelf comprising:

a partition;

a back retainer, proximate a back end of the partition, adapted to mount to the shelf; and a front retainer, proximate a front end of the partition, adapted to mount to the shelf;

wherein at least one of the front and back retainers is resiliently flexible relative to the partition between a relaxed state and an extended state such that a distance between the at least one of the front and back retainers and the partition is selectively variable for mounting the stand alone divider;

wherein the partition is a two part assembly with an adjustable length and comprises:

a first member;

a second member, sized to be received within a channel of the first member; and a pawl mechanism formed between the first and second members, the pawl mechanism operable to lock the first member relative to the second member and vice versa to define an adjusted length of the partition, wherein the pawl mechanism includes a rack and a resiliently flexible locking structure, the rack comprising a plurality of upwardly facing teeth formed on an upwardly facing surface of the second member along a substantial portion of a length of the second member, and wherein the locking structure includes a plurality of downwardly facing teeth such that the plurality of downwardly facing teeth are operably arranged to se1ectively engage and disengage the upwardly facing teeth to adjust an overall length of the partition.

2. The stand alone divider of claim 1, wherein each of the front and back retainers is adapted to receive a front stop transverse to the partition.

3. The stand alone divider of claim 2, wherein the at least one of the front and back retainers comprises:

a clip configured to undercut a lip of the shelf when installed thereon;

a hinge portion connecting the at least one retainer to the partition; and a leg portion extending from the hinge portion and spacing and connecting the clip to the hinge portion, wherein the clip is pivotable forward and rearward relative to the partition.

4. The stand alone divider of claim 3, wherein a vertical post extends upwardly from the leg portion of the at least one retainer, the vertical post being parallel to a proximate edge of the partition, and forming an upwardly opening slot therewith, the upwardly opening slot being adapted to receive the front stop.

5. The stand alone divider of claim 3, wherein the clip of at least one retainer has a groove adapted to receive an o-ring.

6. The stand alone divider of claim 1, wherein the partition comprises a barrier and a base perpendicular to the bottom edge of the barrier, the base having a width greater than the thickness of the barrier.

7. A retail display configuration comprising:

a shelf extending horizontally and having a front and a back edge and a top wall defining an upwardly facing merchandise surface; and at least one stand alone divider for a shelf mounted on the merchandise surface of the shelf, the at least one shelf divider comprising:

a partition;

a back retainer, proximate a back end of the partition, adapted to mount to the shelf at the back edge; and a front retainer, proximate a front end of the partition, adapted to mount to the shelf at the front edge, wherein at least one of the front and back retainers includes a clip configured to undercut the shelf such that a portion of the clip contacts the underside surface of the shelf when installed thereon;

wherein the partition of the at least one stand alone divider is a two-part assembly having an adjustable length and comprises:

a first member;

a second member, sized to be received within a channel of the first member; and a pawl mechanism formed between the first and second members, the pawl mechanism operable to lock the first member relative to the second member and vice versa to define an adjusted length of the partition, wherein the pawl mechanism includes a rack and a resiliently flexible locking structure, the rack comprising a plurality of upwardly facing teeth formed on an upwardly facing surface of the second member along a substantial portion of a length of the second member, and wherein the locking structure includes a plurality of downwardly facing teeth such that the plurality of downwardly facing teeth are operably arranged to selectively engage and disengage the upwardly facing teeth to adjust an overall length of the partition.

8. The retail display configuration of claim 7, wherein at least two stand alone dividers are mounted parallel to each other on the shelf, forming spaces therebetween, further comprising a front stop, received by the at least two stand alone dividers.

9. The retail display configuration of claim 8, wherein a vertical post extends upwardly from at least one of the front and back retainers, the vertical post being parallel to a proximate edge of a partition, and forming an upwardly opening slot therewith, the front stop being received by the upwardly opening slot such that a merchandise display space is bounded by the merchandise surface, the front stop, and at least two stand alone dividers.

10. The retail display configuration of claim 7, wherein the clip of the at least one of the front and back retainers has a groove adapted to receive an o-ring gasket.

11. The retail display configuration of claim 7, wherein the partition of the at least one stand alone divider comprises a barrier and a base perpendicular to the bottom edge of the barrier, the base having a width greater than the thickness of the barrier.

* * * * *